United States Patent [19]

Deane et al.

[11] Patent Number: 4,907,662

[45] **Date of Patent: * Mar. 13, 1990**

[54] ROTARY DRILL BIT HAVING IMPROVED MOUNTING MEANS FOR MULTIPLE CUTTING ELEMENTS

[75] Inventors: John D. Deane; Percy W. Schumacher, both of Houston, Tex.

[73] Assignee: Reed Tool Company, Houston, Tex.

[ * ] Notice: The portion of the term of this patent subsequent to Jul. 28, 2004 has been disclaimed.

[21] Appl. No.: 84,892

[22] Filed: Aug. 13, 1987

Related U.S. Application Data

[63] Continuation-in-part of Ser. No. 61,413, Jun. 12, 1987, which is a continuation of Ser. No. 830,399, Feb. 18, 1986, Pat. No. 4,682,663.

[51] Int. Cl.[4] ..... E21B 10/46

[52] U.S. Cl. ..... 175/329; 175/410; 408/144; 408/145

[58] Field of Search ..... 408/144, 145; 407/57, 407/118, 119; 175/329, 373, 374, 410

[56] References Cited

U.S. PATENT DOCUMENTS

| | | | |
|---|---|---|---|
| 4,156,329 | 5/1979 | Daniels et al. | 175/329 |
| 4,225,322 | 9/1980 | Knemeyer | 175/329 |
| 4,303,136 | 12/1981 | Ball | 175/329 |
| 4,429,755 | 2/1984 | Williamson | 175/329 |
| 4,440,246 | 4/1984 | Jurgens | 175/329 |
| 4,442,909 | 4/1984 | Radtke | 175/329 |
| 4,452,324 | 6/1984 | Jurgens | 175/393 |
| 4,499,958 | 2/1985 | Radtke et al. | 175/329 |
| 4,505,342 | 3/1985 | Barr et al. | 175/410 |
| 4,533,004 | 8/1985 | Ecer | 175/329 |
| 4,682,663 | 7/1987 | Daly et al. | 175/329 |

FOREIGN PATENT DOCUMENTS

| | | | |
|---|---|---|---|
| 0117241 | 8/1984 | European Pat. Off. | 175/329 |
| 0155026 | 9/1985 | European Pat. Off. | 175/329 |
| 0157278 | 10/1985 | European Pat. Off. | 175/329 |

OTHER PUBLICATIONS

"Compax ® Diamond Drilling Update", Specialty Materials Division–General Electric Company, Jun. 1975.

"Field Test of an 8½ Inch Polycrystalline Diamond Blade Bit in Colombia", for GoTech, by D. S. Rowley, Drilling Research Laboratory, Dec. 1985.

*Primary Examiner*—Z. R. Bilinsky

*Attorney, Agent, or Firm*—Dodge Bush & Moseley

[57] ABSTRACT

A drag type drill bit (10) having a plurality of solid block-like holders (30, 32, 34) secured to and projecting from the bit body (12), each holder (30) having a plurality of cutting elements (36) thereon defining spaced cutting edges 54. Each cutting element (36) has a planar cutting face (46) and a cutting edge (54) extending along the cutting face (46) with the cutting face (46) extending in a generally radial direction with respect to the axis of rotation of the bit (10). The holders (30, 32, 34) are arranged in a plurality of rows extending outwardly from adjacent the axis of rotation of the drill bit (10) and the holders (30, 32, 34) in each row are staggered rearwardly with respect to the direction of rotation.

10 Claims, 3 Drawing Sheets

ROTATION

ROTARY DRILL BIT HAVING IMPROVED MOUNTING MEANS FOR MULTIPLE CUTTING ELEMENTS

Cross Reference to Copending Application

This application is a continuation-in-part of application Ser. No. 061,413, filed June 12, 1987; which is a continuation of Ser. No. 830,399, filed Feb. 18, 1986, now U.S. Pat. No. 4,682,663, issued July 28, 1987.

BACKGROUND OF THE INVENTION

This invention relates to a rigid holder for mounting a plurality of cutting elements in a drag type rotary drill bit, and more particularly to a rigid integral holder or carrier for a plurality of polycrystalline diamond cutting elements mounted on a unitary holder which is secured directly to the exterior face of the drill bit.

Heretofore, drag type rotary drill bits have been provided with a plurality of separate polycrystalline diamond compact (PDC) cutting elements, but normally each PDC cutting element has been mounted on a separate stud secured to a separate blade or secured within pockets formed directly on the exterior of the drill bit, such as, for example, by brazing, welding, or press fitting within a recess in the face of the bit. In some instances, separate PDC cutting elements without studs have been mounted directly on the drill bit face.

The two main bit problems encountered in drilling which tend to result in decreased penetration of a formation are deterioration or wear of the cutting elements resulting primarily from heat degradation, and "balling" of the bit face. "Balling" or sticking is caused by a sticky formation, such as sticky shales or similar formations having a large percentage of clays, adhering to the cutting face of the bit. This may occur in certain formations where the hydraulic action of drilling mud is inadequate, or where hydraulic passages in the bit may be poorly designed and result in an inefficient flow of mud across the face of the bit. It is noted that for drilling offshore the continental United States, water base muds are normally employed as government regulations generally render the use of oil base muds cost prohibitive. The use of water base muds may result in substantial "balling", particularly when drilling in sticky shales or similar formations.

It is noted that a worn PDC type bit normally forms wear flat surfaces adjacent the diamond cutting edges of the cutting elements and this causes a reduction in the penetration rate of the bit as the cutting edges do not penetrate as deeply into the formation. As the cutting elements wear, increasingly larger wear flats are formed adjacent the cutting edges. The increased size wear flats require an increasingly higher weight on the bit to maintain a constant rate of penetration into the formation thereby resulting in a higher torque requirement for rotating the bit and in a higher heat generated in the cutting elements.

The stud or support on which the PDC cutting element is mounted sometimes fractures or shears upon continued use, such as when the bit is suddenly pulled off-bottom, or if a bit bounce occurs. The cutting elements are susceptible to thermal shock as a result of rapid cooling by water or drilling mud in addition to unfavorable temperature gradients that develop combined with the sudden removal of the compressive stresses due to bit weight. This causes tension on the supports for the cutting elements. It is noted that the compressive and tensile stresses throughout the cutting elements and their supports are significantly increased under conditions in which the wear flat temperatures are around three hundred and fifty (350) degrees Centigrade. This, of course, increases the possibility of shearing or breakage of the support studs on which the PDC cutting elements are mounted. Also, the greater the projection of the support for the PDC cutting elements from the adjacent face of the drill bit, the greater the amount of stress provided on the supports from the cutting action which likewise will increase the possibility of breakage or shearing of the supports for the PDC cutting elements.

It has been found that the cutting element develops a significant wear flat by the time fifty percent (50%) of its useful life has been expended. Thus, PDC cutting elements should be designed to provide a minimal wear flat for effective operation. To maximize the life of a PDC cutting element, the rotary drill bit should be operated under conditions so that thermally accelerated wear does not occur and to reduce such wear, the rotary drill bit should be operated at a rotary speed and bit weight which does not cause the thermal wear effects to become critical at over around three hundred and fifty (350) degrees Centigrade.

Heretofore, blades have been provided on some drag type rotary drill bits having a plurality of PDC cutting elements thereon. For example, U.S. Pat. No. 4,499,958 dated Feb. 19, 1985, shows a drag type rotary drill bit with a plurality of cutting blades welded to the face of the drill bit with each cutting blade having a plurality of studs mounted thereon, each stud having a PDC cutting element on its projecting end. However, the studs are spaced a substantial distance from each other along the length of the cutting blade and each stud or support has only a single PDC cutting element thereon.

Also, U.S. Pat. No. 4,440,246 dated Apr. 3, 1984 shows a rotary drill bit with a wedge-shaped cutting member defining two PDC cutting faces formed from cutting elements extending generally at right angles to each other and mounted on a stud or carrier member secured to the bit body for providing a ploughing action against the formation.

Various other references, such as exemplified by U.S. Pat. No. 4,429,755 dated Feb. 7, 1984, show drag type rotary drill bits with stud mounted PDC cutting elements projecting from the outer face of the drill bits and arranged in various patterns on the face of the drill bit. The studs are normally secured on the face of the drill bit by brazing, welding, or press fitted within openings or recesses along the face. Various types of nozzles for drag type drill bits are illustrated in U.S. Pat. Nos. 4,303,136 dated Dec. 1, 1981 and 4,452,324 dated June 5, 1984.

SUMMARY OF THE INVENTION

This invention is directed generally to drag type rotary drill bit having polycrystalline diamond cutting elements similar to the Stratapax type manufactured by the General Electric Company and described in Daniels, et al U.S. Pat. No. 4,156,329 dated May 29, 1979 and Knemeyer U.S. Pat. No. 4,225,322 dated Sept. 30, 1980, and more particularly to means for mounting such cutting elements on the drill bit. The Stratapax type cutting element has an outer thin diamond layer secured to a hard carbide metal substrate or base. The outer diamond layer defines a planar cutting face and cutting edge secured to the hard metal base which has a rear support face secured, such as by brazing, to a support projecting from the face of the drill bit. Such Stratapax type cutting elements are in wide commercial usage. The term "diamond", "polycrystalline diamond" or "PDC" cutting elements as used in the specification and claims herein shall be interpreted as including all diamond or diamond-like cutting elements having a hardness generally similar to the hardness of a natural diamond.

In the present invention, the mounting means for the PDC cutting elements comprises an elongated rigid support body or holder for two or more PDC cutting elements of the Stratapax type having leading planar faces in planes extending in a generally radial direction with respect to the axis of rotation of the drill bit. The elongated unitary holder or block support has a base portion secured or mounted on the outer face of the drag type drill bit by suitable securing means, such as by welding, brazing, or press fitting within a recess or opening in the face, and a projecting end portion extending from the base portion having the cutting elements thereon for engaging a formation in cutting relation.

The utilization of a single support body or holder for two or more Stratapax type PDC cutting elements extending in a radial direction with respect to the axis of rotation of the drill bit has several advantages. First, as a result of a PDC support having a solid block metal base portion of an increased cross section, an increased strength is provided which minimizes breaking or shearing of the support. Also, as a result of the increased strength of the support, the projecting end portion of the support may extend further from the face of the drill bit than heretofore, thereby to reduce a tendency for balling of the drill bit from sticky formations. The increased strength of the PDC support permits a tapering of the projecting end portion of the support with a steep backside rake, thereby providing a minimal rubbing contact or wear flat surface adjacent the cutting edges of the cutting elements, particularly upon wear of the cutting edges. The relatively small wear flat surfaces adjacent the cutting edges results in relatively sharp cutting edges which maximize the rate of penetration for the cutting elements. A minimal wear flat surface is maintained during wear of the cutting elements as the tapered supporting back side extends for the entire extent of the cutting elements. Thus, it is important for maximizing the rate of penetration that a minimal wear flat surface be provided at all times.

Drilling fluids discharged from nozzles aid in cooling the cutting elements, as well as aiding in removing the chips or rock cuttings in front of the cutting elements when the jet or spray is directed in advance of the cutting elements. The discharge nozzles may be positioned at various locations and provided in a variety of different embodiments, such as having a discharge opening of an elongate or oval shape so that the fluid is directed against a plurality of the cutting elements for washing over the cutting elements in advance of the cutting operation, or for directing the fluid directly in the formation.

Copending application Ser. No. 830,399, filed Feb. 18, 1986 disclosed embodiments of a drag type rotary drill bit in which the separate cutting elements for each unitary holder or support were in a single common plane extending generally radially of the axis of rotation of the bit. Further, the holders for each row of cutting elements were disclosed as extending in a single common plane extending generally radially of the axis of rotation.

The present invention is directed particularly to unitary holders or supports for a plurality of cutting elements in which the holders or cutting elements have planar leading surfaces which do not extend in a single common plane. While each individual cutting element has a cutting edge or planar leading surface which extends in a plane generally radially of the axis of rotation of the associated rotary drill bit, the plurality of cutting elements on each holder in some modifications are not arranged in a single common plane and are spaced from each other but yet maintain the effectiveness obtained by holders having a plurality of cutting elements thereon arranged in a single common plane. If not arranged in a single common plane, the cutting elements have more flexibility in design and the holder on which the cutting elements are mounted may be exposed to a decreased bending moment resulting from the cutting elements having staggered cutting contact with the formation with respect to the direction of rotation. In other modifications, the holders for each row of cutting elements are not arranged in a single common plane but are arranged in a staggered relation or have shapes other than generally rectangular shapes, such as arcuate shapes, for example.

It is an object of this invention to provide a drag type rotary drill bit having a plurality of adjacent polycrystalline diamond compact (PDC) cutting elements the mounted on a unitary rigid support holder mounted directly on the body of the drill bit.

An additional object of this invention is to provide such a rotary drill bit in which the plurality of PDC cutting elements are mounted on a unitary holder and project a maximum distance from the adjacent face of the drill bit and have cutting edges spaced from each other to form individual spaced cuts or kerfs in the formation being drilled.

It is a further object of this invention to provide a single holder or support for a plurality of PDC cutting elements on a drag type rotary drill bit with the support formed of a sintered tungsten carbide metal and having a tapered end portion projecting from the face of the bit and terminating adjacent the cutting elements, thereby to provide a minimal wear flat surface adjacent the cutting elements upon wear thereof.

An additional object is to provide such a holder for a plurality of cutting elements in which the cutting elements are spaced laterally and staggered rearwardly from each other with respect to the direction of rotation.

Other objects, features, and advantages of this invention will become more apparent after referring to the following specification and drawings.

DESCRIPTION OF THE INVENTION

Figure 2:
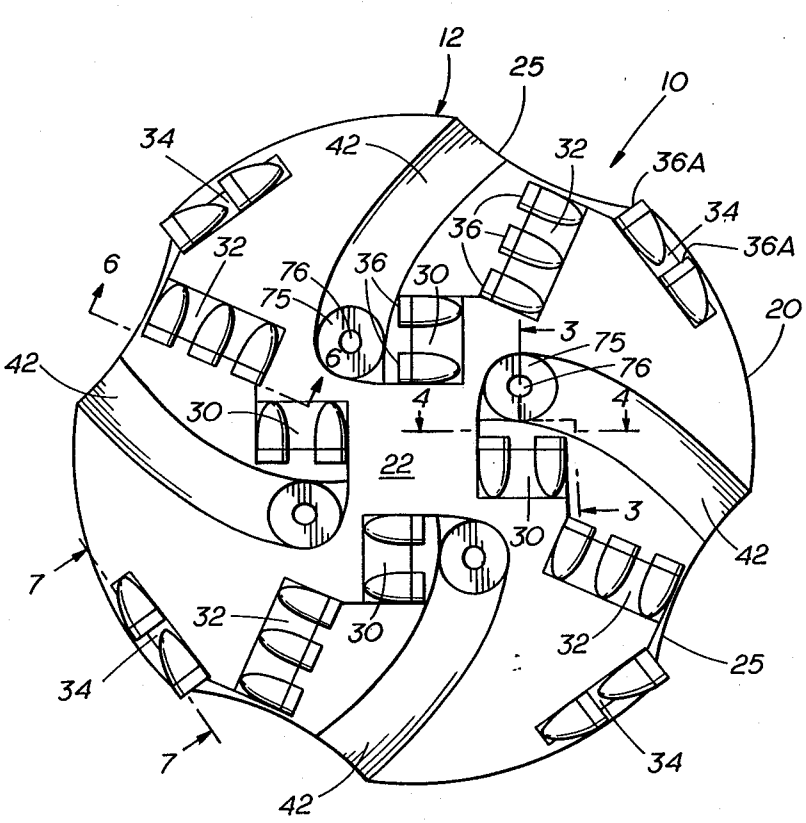
FIG. 2 is a bottom plan of the drag type drill bit shown in FIG. 1 showing the cutting elements and associated mounting means forming the present invention arranged on the outer face of the drill bit body.
Figure 1:
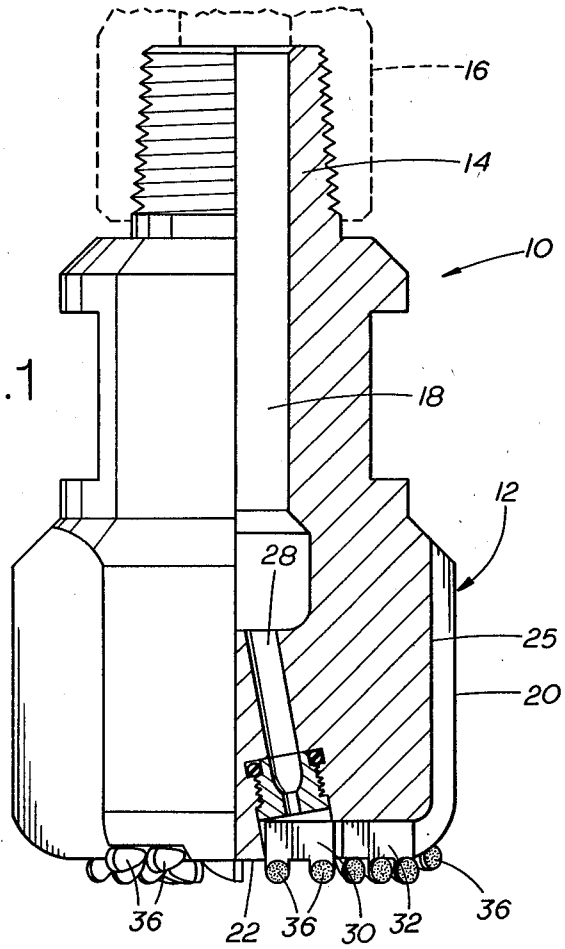
FIG. 1 is an elevational view, partly in section, showing a drag type rotary drill bit having means for mounting cutting elements forming this invention thereon.

Referring particularly to FIGS. 1 and 2, a drag type rotary drill bit is shown generally at 10 having a generally cylindrical bit body 12 with an externally threaded pin 14 a its upper end. Pin 14 is threaded within the lower end of a drill string indicated generally at 16 which is suspended from a drill rig at the surface for rotating drill bit 10. Drill bit body 12 has a longitudinally extending main fluid passage 18 which is adapted to receive drilling mud or fluid from the drill rig for the drilling operation.

Bit body 12 has an outer peripheral surface 20 forming the outer gage thereof and a lower face 22. Grooves or indentations 25 are formed in outer peripheral surface 20 to form flow passages for the upward flow of drilling fluid. An auxiliary flow passage 28 is in fluid communication with main flow passage 18 and receives drilling fluid therefrom for discharge as will be explained. Bit body 12 defines suitable flow passages thereabout for flow of the discharged drilling fluid with cuttings and the like. It is to be understood that bit body 12 can be formed of various shapes or designs depending, for example, on such factors as the type of formation, the type of cutting elements employed, and the mud program proposed, for example. Bit body 12 may be formed of any suitable material, such as various types of steels, or infiltrated tungsten carbide.

Referring to FIG. 2, separate holders or supports generally indicated at 30, 32, and 34 are shown arranged generally along four rows on lower face 22 of drill bit 10. Each holder 30, 32, and 34 has at least two cutting elements generally indicated at 36 mounted thereon. Holder or support 30 is specifically illustrated in FIGS. 3–5 and will be described in detail, it being understood that holders 32 and 34 are generally similar to holder 30 but with cutting elements 36A on holder 34 being staggered rearwardly with respect to the direction of rotation of drill bit 10.

Figures 3, 4, 5, 6, 7, 9:
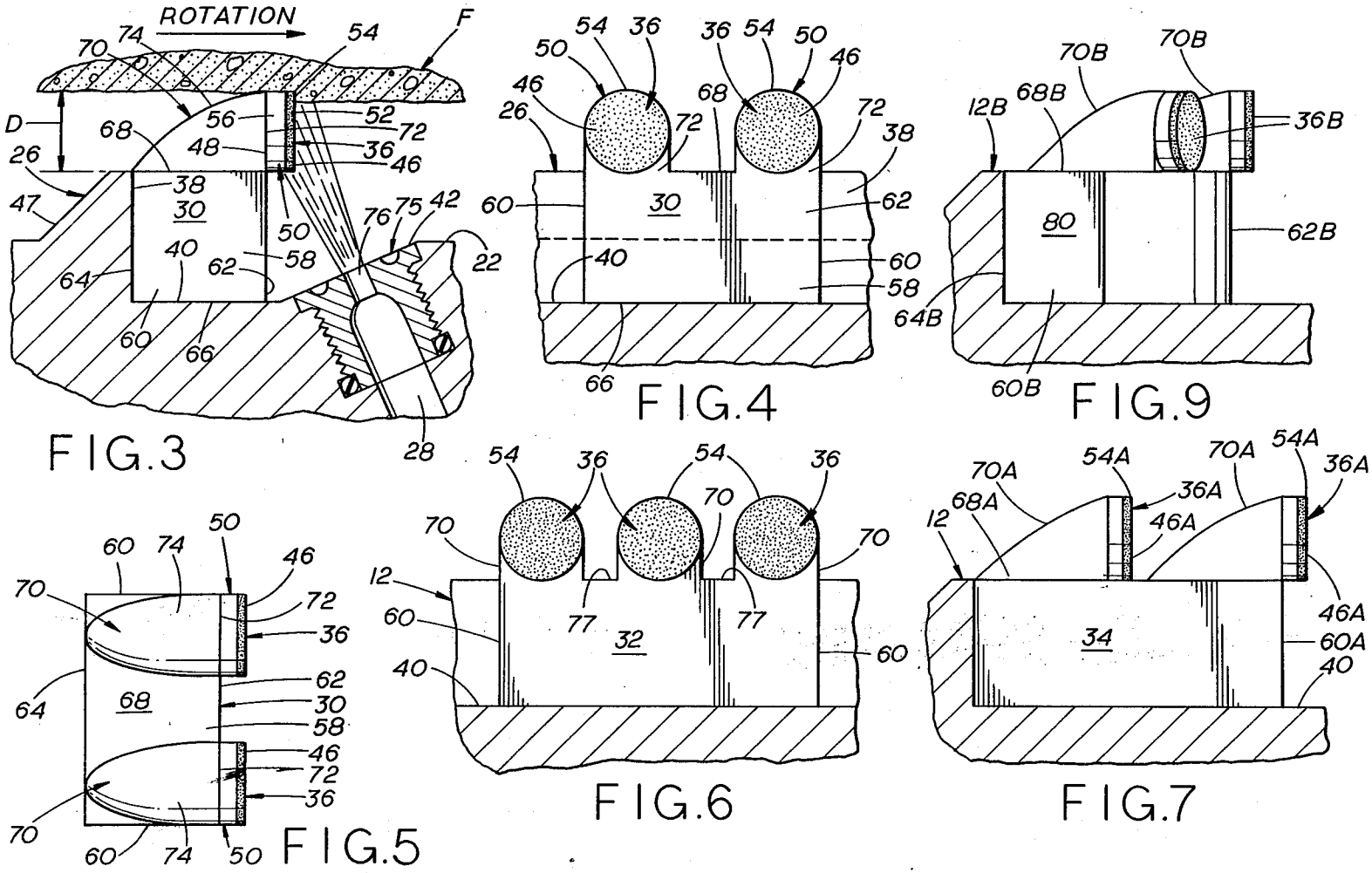
FIG. 3 is a section taken generally along the line 3—3 of FIG. 2 showing a single holder or support on the drill bit body mounting a plurality of cutting elements thereon and a discharge nozzle on the bit body adjacent the support.
FIG. 4 is a section taken generally along the line 4—4 of FIG. 2 and showing the holder of FIGS. 2 and 3 in front elevation with the leading planar cutting faces of the cutting elements illustrated.
FIG. 5 is a top plan of the holder of FIG. 4 and the plurality of cutting elements mounted thereon.
FIG. 6 is a section taken generally along line 6—6 of FIG. 2 and showing another holder on the drill bit with three cutting elements thereon.
FIG. 7 is a side elevation of an additional holder illustrated in FIG. 2 arranged at the gage of the bit body.
FIG. 9 is a section taken generally along line 9—9 of FIG. 8 and showing a holder with a discharge nozzle adjacent the holder.

Projection 26 on drill bit body 12 as shown on FIGS. 3–5 forms an abutting planar surface at 38 facing the direction of rotation of drill bit 10 and an adjacent bit surface 40 extending in a generally transverse direction to surface 38. Surface 40 is connected by an inclined surface 42 to bit surface 22 to form a continuation of surface 22. Holder 30 is brazed to projection 26 along surfaces 38 and 40. Holder 30 has two cutting elements 36 mounted thereon. Each cutting element 36 is identical and comprises a generally cylindrical shape having parallel planar front and rear faces 46 and 48 connected by an outer generally cylindrical peripheral surface 50 extending at right angles to planar faces 46 and 48. Each cutting element 36 includes an outer thin diamond layer 52 defining front leading face 46 which forms the planar cutting face and arcuate cutting edge 54 about face 46. Diamond layer 52 is suitably secured, such as by sintering, to a tungsten carbide base 56 which defines rear face 48. While the thin diamond layer 52 is preferably formed of a polycrystalline (man-made) diamond structure, it may be formed of other materials, such as, for example, ceramics, or cubic boron nitride.

While cutting element 36 is preferably of a generally cylindrical shape of the Stratapax type manufactured by the General Electric Company, it is to be understood that cutting element 36 may be of different shapes to define a suitable leading planar cutting face and cutting edge along the cutting face for engaging a formation to be bored or cut, such as, for example, a semicircular or triangular shape.

Holder 30 is an integral solid block body 58 formed preferably of a sintered tungsten carbide material. Block body 58 has generally parallel ends 60 connected by generally parallel respective front and rear sides 62 and 64. As shown particularly in FIGS. 3 and 4, body 58 has a lower base surface 66 and an upper surface 68. Projecting upwardly from upper surface 68 is a tapered end portion 70 for each cutting element 36. Each end portion 70 has a planar front surface 72 on which cutting element 36 is secured, and an inclined rearwardly tapering upper surface 74. End portion 70 and associated cutting element 36 project outwardly from surface 68 a substantial amount and end portion 70 presents a relatively small wear surface for rubbing against the formation F to be cut. Cutting edge 54 is defined primarily by peripheral surface 50 which extends at right angles to outer cutting face 46. Cutting element 36, if desired, may be provided with a negative rake with respect to the adjacent surface of formation F being cut.

Upon wear of cutting elements 36, the relatively small wear flat area or surface provided results in a minimum of rubbing friction against the formation upon rotation of drill bit 10 and likewise results in a minimum of heat generated by such rubbing friction, particularly upon the utilization of a worn bit. A wear flat area provides rubbing friction against a formation being cut upon rotation of an associated drill bit, thereby generating heat and requiring additional rotational torque for rotation of the associated drill bit. It is noted that with PDC cutting elements, about fifty percent (50%) of the life of the bit is with worn cutting elements. Therefore, it is highly desirable to have a minimum area in contact with the formation for minimizing rubbing frictional contact with the formation.

Holder 30 provides strength to the plurality of cutting elements 36. It is noted that a maximum stress resulting from the cutting operation is not normally exerted against all of the cutting elements 36 on holder 30 simultaneously. Thus, if only a single cutting element 36 is exposed to maximum stress at any one time, the residual strength of the adjacent portions of holder 30 may be utilized by the cutting element having such maximum stress. Thus, by providing holder 30 with a plurality of cutting elements 36, breakage or shearing of holder 30 is minimized.

Further, as a result of such strength, holder 30 may project a maximum distance from the adjacent bit surface 22 such as illustrated at D in FIG. 3. As an example, projection D may preferably be between one and two times the radius of cutting elements 36. Holder 30 may be formed of tungsten carbide having a Rockwell A hardness of eighty (80) to ninety-five (95) and a stiffness as measured by Young's modulus of elasticity of sixty to ninety million pounds per square inch (psi). Such a holder 30 has been found to provide the necessary strength utilizing tapered projecting end portion 70 as shown.

An externally threaded fluid discharge nozzle is indicated generally at 75 and is threaded within an opening in inclined surface 42 and has a fluid discharge opening 76 leading to auxiliary fluid passage 28 in fluid communication with main flow passage 18. Discharge opening 76 may be of an oval shape and is arranged at an angle with respect to bit surface 22 to provide a relatively long jet or stream directed against the formation in advance of cutting elements 36. The discharged fluid also washes against faces 46 of cutting elements 36 and tends to remove cuttings or the like from the formation prior to the cutting action of cutting elements 36. The discharged fluid further cools cutting elements 36 mounted on holder 30. The spacing of cutting elements 36 and cutting edges 54 from each other permits separate or individual cuts or kerfs to be made by each of the cutting elements 36.

Referring to FIG. 6, holder 32 shows three spaced cutting elements 36 mounted thereon with projecting end portions 70 extending outwardly from the adjacent surface 77 of holder 32.

Referring to FIG. 7, holder 34 mounted on the outer periphery or gage of drill bit body 12 as shown in FIG. 2 is illustrated. Leading and trailing cutting elements 36A are mounted on holder 34 at the same distance from the axis of rotation of drill bit 10. Thus, trailing cutting element 36A follows the same path as leading cutting elements 36A. Cutting edges 54A along planar leading faces 46A of cutting elements 36A extend laterally beyond the gage of drill bit body 12 for engaging the formation along the side of the bore hole. Leading or front cutting element 36A is mounted on a front end 60A of holder 34 and end portions 70A project outwardly from adjacent surface 68A in a manner similar to end portions 70 on holder 30.

Figure 8:
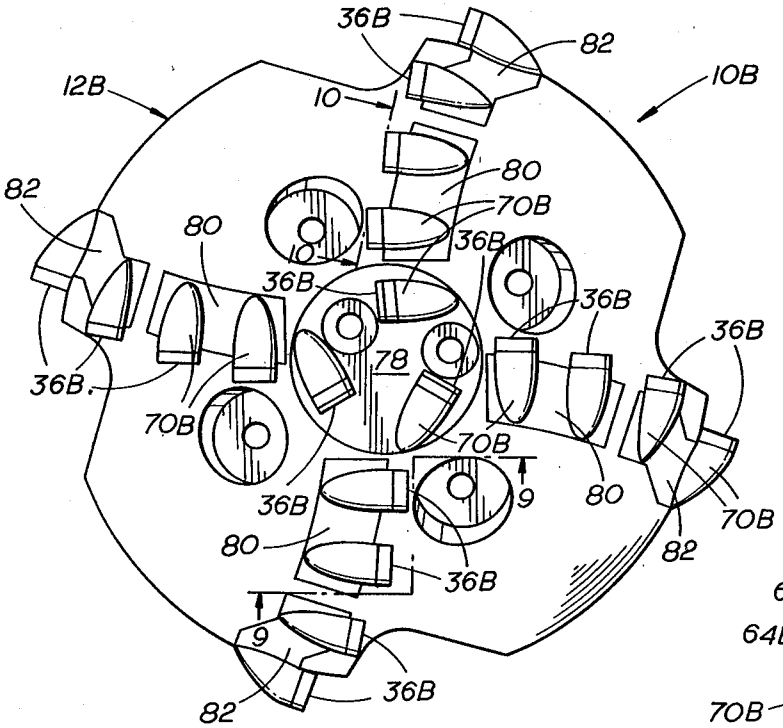
FIG. 8 is a bottom plan of a modified drag type drill bit illustrating a plurality of holders arranged in a plurality of generally arcuate rows on the drill bit, each holder having a plurality of cutting elements mounted thereon.

Referring now to FIGS. 8–12, further embodiments of the present invention are illustrated. Referring particularly to FIG. 8, drill bit 10B has a drill bit body 12B. Projecting from bit body 12B are a center holder 78 having three (3) cutting elements 36B thereon, intermediate arcuate holders 80 each having a pair of spaced cutting elements 36B thereon, and arcuate outer holders 82 each having a pair of cutting elements 36B thereon with the outer cutting element 36B extending beyond the gage defined by drill bit body 12B. Each holder 78, 80 and 82 thus has at least two (2) cutting elements 36B mounted thereon. Holders 80 and 82 extend from the outer circumference of center holder 78 generally in arcuate rows from the outer circumference of holder 78 to the gage of drill bit body 12B. Center holder 78 is of a cylindrical shape and projecting end portions 70B have cutting elements 36B secured thereto in a manner similar to the embodiment shown in FIGS. 3–5.

Figure 10:
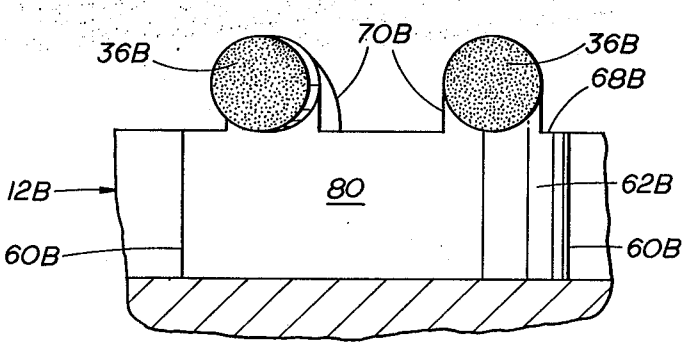
FIG. 10 is a section taken generally along line 10—10 of FIG. 8 and showing the modified holder of FIG. 8 in front elevation.
Figure 11:
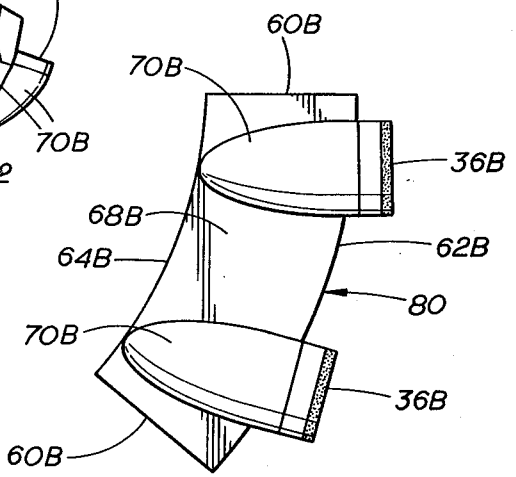
FIG. 11 is a top plan of the holder and cutting elements shown in FIGS. 9 and 10.

Holder 80 as shown particularly in FIGS. 9–11 has an arcuate front leading surface 62B of a generally convex curvature and a rear surface 64B of a generally concave shape. End portions 70B project upwardly from upper surface 68B and end surfaces 60B connect surfaces 62B and 64B.

Figure 12:
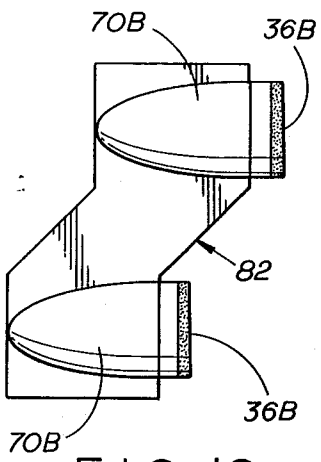
FIG. 12 is a top plan of another holder mounted on the rotary drill bit of FIG. 8 at the gage thereof with the holder having offset cutting elements thereon.

End holder 82 as shown in FIG. 12 has a pair of projecting end portions 70B with cutting elements 36B mounted thereon. The outer cutting element 36B extends beyond the gage formed by body 12B and is spaced rearwardly or trails the other cutting element 36B with respect to the direction of rotation of bit body 12B. Cutting elements 36B and projecting end portions 70B are similar to the corresponding cutting elements 36 and projecting end portions 70 as shown in the embodiment shown in FIGS. 3–5.

It is apparent that various shapes and types of integral holders or mounting means for a plurality of cutting elements may be provided in accordance with the invention. Likewise, a variety of discharge nozzles may be provided in association with the holder and associated cutting elements for providing drilling fluid in advance of the cutting operation to remove cuttings and to cool the cutting elements. By having elongate discharge nozzles, a minimum number of discharge nozzles is required and the elongate openings, by being relatively long, are very difficult to clog with cuttings or the like. A simplified manufacture of holders is also provided by having two or three cutting elements mounted on each holder.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. In a drag type rotary drill bit having a bit body defining a lower exterior surface;

a plurality of unitary integral hard metal holders secured in a spaced relation to each other directly to said bit body each having a projecting end portion extending from said lower surface of the bit body; and a plurality of polycrystalline diamond cutting elements mounted directly on the projecting end portion of each of said holders, each cutting element having a planar leading cutting face and a cutting edge along said face projecting from an associated holder for engaging in cutting relation a formation to be cut, each of the cutting edges of the plurality of cutting elements for each holder being spaced laterally from the cutting edge on any adjacent cutting element and in a cutting plane extending generally radially of the axis of rotation of the bit, said holder providing reinforcement and rigidity to said cutting elements in resisting stresses resulting from the cutting operation.

2. The drag type rotary drill bit as set forth in claim 1 wherein said plurality of holders are staggered in a rearward trailing relation to each other from a position adjacent the axis of rotation of the drill bit to the outer surface thereof.

3. The drag type rotary drill bit as set forth in claim 2 wherein said plurality of cutting elements on at least one holder are staggered in a rearward trailing relation to each other with respect to the direction of rotation of the drill bit.

4. In a drag type rotary drill bit having a bit body defining a lower exterior surface;

a plurality of unitary integral hard metal holders secured directly to said bit body each having a projecting end portion extending from said lower surface of the bit body, said projecting end portions having support faces thereon; and a plurality of polycrystalline diamond cutting elements mounted directly on said support faces of said projecting end portions of said holders, each cutting element having a planar leading cutting face and a cutting edge along said cutting face projecting from an associated projecting end portion for engaging in cutting relation a formation to be cut, each of the cutting edges of the plurality of cutting elements for at least one holder being spaced laterally from the cutting edge on any adjacent cutting element and in a cutting plane extending generally radially of the axis of rotation of the bit for engaging the formation in cutting relation in a cutting path laterally spaced from the cutting path of the remaining plurality of cutting elements on the associated holder, said holders providing reinforcement and rigidity to said cutting elements in resisting stresses resulting from the cutting operation.

5. In a drag type rotary drill bit as set forth in claim 4 wherein one of said plurality of holders comprises a center holder positioned in generally vertical alignment with the axis of rotation of the drill bit.

6. In a drag type rotary drill bit as set forth in claim 4 wherein said plurality of holders are arranged in rows extending in a generally arcuate direction from a position adjacent the axis of rotation to the outer gage of said bit body.

7. In a drag type rotary drill bit as set forth in claim 4 wherein the cutting elements on at least one holder are staggered in a rearward trailing relation to each other with respect to the direction of rotation of the drill bit.

8. In a drag type rotary drill bit having a generally cylindrical bit body with a fluid passage therein and adapted to be connected to a drill string for rotation therewith and to receive drilling fluid therefrom; an improved cutting means on the outer face of the generally cylindrical bit body comprising:

a plurality of solid block-like hard metal supports each having a base portion secured directly to said drill bit body, each of said supports having an end portion projecting from the base portion and extending from the outer face of said drill bit body, said projecting end portion having a leading planar face extending generally radially of the axis of rotation of the drill bit; and a plurality of separate cutting elements on each metal support having planar rear faces secured directly to a leading planar face on an associated support and having cutting edges extending outwardly beyond said projecting end portion, said solid block-like support providing rigidity to said cutting elements in resisting stresses resulting from the cutting operation.

9. In a drag type rotary drill bit having a bit body with a fluid passage therein leading to an outer face thereof, the bit body connected to a drill string for rotation therewith and to receive drilling fluid therefrom; improved cutting means for said drill bit body comprising:

a plurality of solid block-like metal supports arranged in a plurality of rows on said drill bit body each row extending from a position adjacent the axis of rotation of the drill bit to the outer surface thereof, the supports in each row being staggered rearwardly with respect to the direction of rotation, each support having a base portion secured to said drill bit body and an outer projecting end portion extending from said outer face of the drill bit body, said metal support having a planar leading support surface on said projecting end portion;

a plurality of cutting elements on each metal support each having a leading planar cutting face and a trailing planar support face with the cutting face defining an outer cutting edge, said planar support face secured to said leading planar surface of the associated metal support for securing the associated cutting element thereon, said plurality of cutting elements having their cutting edges extending in a generally transverse direction with respect to the axis of rotation of said drill bit; and a fluid discharge nozzle in fluid communication with said fluid passage in said bit body positioned on the bit body for discharging drilling fluid against the formation to be cut.

10. In a drag type rotary drill bit as set forth in claim 9 wherein a center generally cylindrical support is mounted on said bit body in vertical alignment with the axis of rotation of said drill bit.

* * * * *